US007922549B1

(12) United States Patent
Sirota et al.

(10) Patent No.: US 7,922,549 B1
(45) Date of Patent: Apr. 12, 2011

(54) OAR WITH PIVOTAL BLADES

(76) Inventors: Anatoliy Sirota, Chestnut Hill, MA (US); Mikhail Sirota, Newton, MA (US); Aleksey Sirota, Wayland, MA (US); Artem Sirota, Chestnut Hill, MA (US)

( * ) Notice: Subject to any disclaimer, the term of this patent is extended or adjusted under 35 U.S.C. 154(b) by 0 days.

(21) Appl. No.: 12/322,526

(22) Filed: Feb. 4, 2009

(51) Int. Cl.
*B63H 1/32* (2006.01)

(52) U.S. Cl. ..... 440/20

(58) Field of Classification Search ..... 440/13, 440/14, 17, 19, 20, 21; 416/79, 82, 83
See application file for complete search history.

(56) References Cited

U.S. PATENT DOCUMENTS

| | | | | | |
|---|---|---|---|---|---|
| 9,366 | A * | 11/1852 | Kellsey | ..... | 416/83 |
| 80,960 | A * | 8/1868 | Hunter | ..... | 416/82 |
| 233,209 | A * | 10/1880 | Coulter | ..... | 416/83 |
| 461,067 | A * | 10/1891 | Ainslie | ..... | 416/83 |
| 791,852 | A * | 6/1905 | Worcester | ..... | 416/82 |
| 1,208,063 | A * | 12/1916 | White | ..... | 440/19 |
| 1,828,983 | A * | 10/1931 | Rawlings | ..... | 440/19 |
| 2,507,205 | A * | 5/1950 | Griffin | ..... | 440/20 |
| 2,873,713 | A * | 2/1959 | Baastrup | ..... | 440/20 |
| 3,122,122 | A * | 2/1964 | Jenkins | ..... | 440/19 |
| 7,520,788 | B1 * | 4/2009 | Gonzalez | ..... | 440/17 |

* cited by examiner

*Primary Examiner* — Lars A Olson

(57) ABSTRACT

An oar or paddle for moving forward and backward any kind of vessel through the water comprising two parallel lattices fixed at a given distance from each other and a frame moving between lattices. The frame has a multitude of parallel grooves of circular cross-section which pivotally support a multitude of plates. The plates are located axially of the grooves by the portion of the plates disposed within the groove. The grooves have a peripheral extent which permits the plates to rotate. The frame is connected with vessel's mode of movement backward or forward controller. Lattices are connected with vessel's engine.

6 Claims, 6 Drawing Sheets

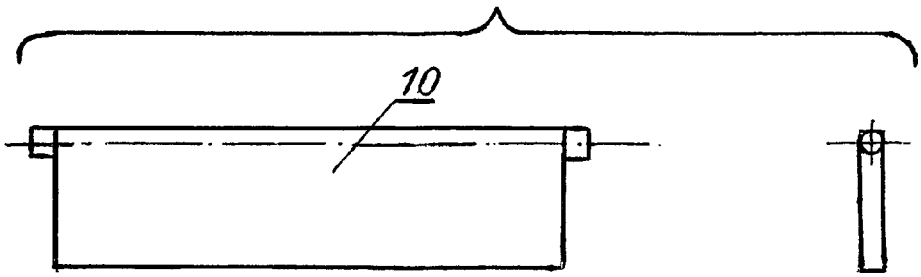
FIG. 3
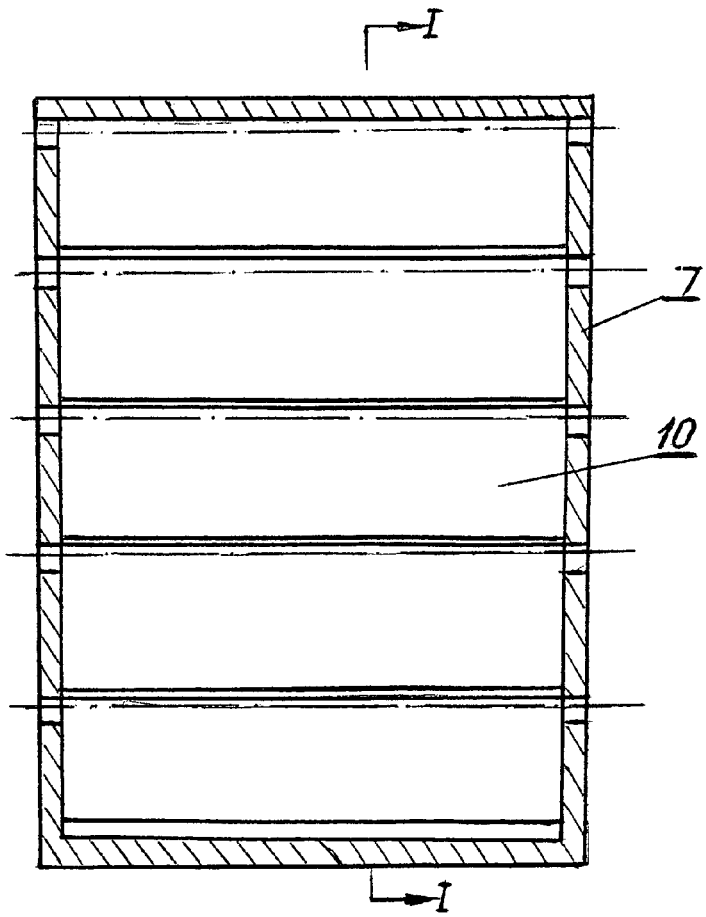
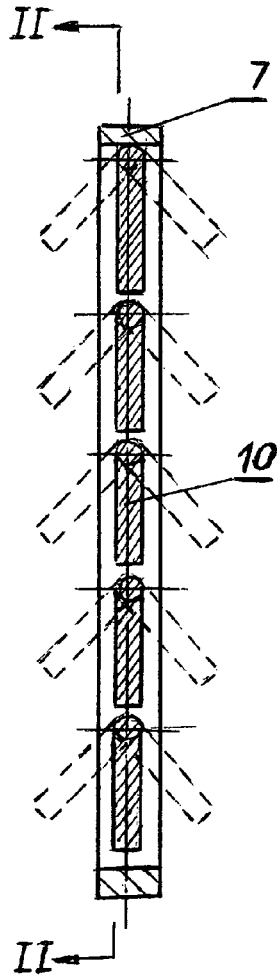
FIG. 4
FIG. 4A

OAR WITH PIVOTAL BLADES

BACKGROUND OF THE INVENTION

1. Field of the Invention

This invention is related to oars, paddles and the like which are used to move forward and backward any and all vessels over water, even if they have any type of engine.

2. History of the Prior Art

Oars, paddles and the like usually comprise a shaft having an integral blade at one end thereof which, when the oar is moved through water, with the blade disposed at right angles to the direction of movement of the oar, causes a reaction which propels the boat.

At the end of each such stroke or movement of the oar or paddle, it is lifted out of the water, returned to its initial position and the propelling stroke repeated.

It would be desirable, and would reduce the energy used by an operator, if the oar or paddle blade could remain immersed in the water during the return stroke, but with oars or paddles constructed as described above, this would not be possible because of the resistance of the water on the integral blades.

It has previously been proposed in Canadian Pat. No. 262860 (Beebe) to construct an oar in which the blades are pivotally mounted on a frame attached to a shaft, the frame member being constructed such that when the blades are moved to a position at right angles to the direction of movement of the oar by the resistance of the water, they are retained in the divergent position. In addition the frame includes stop means positioned so that during the return stroke of the oar with the blades still in the water, the blades will be moved into engagement with the stop by the resistance of the water so as to lie parallel with each other.

It has previously been proposed in U.S. Pat. Nos. 427,842, 1,066,662, 1,555,097, 1,805,749, 3,135,977, 4,622,017 to construct an oar or paddle having pivotal blades, in which the means for pivotally supporting the blades and for limiting the pivotal movement are formed integrally with the shaft.

It has previously been proposed in U.S. Pat. No. 7,309,364 to construct a flat substance which can be easily and more conveniently stored within small areas of most any water craft before being folding assembled.

The main disadvantage of devices designed according to patents mentioned above is that they are geared for a sole usage of an operator's manual energy and cannot sustain higher energy and larger vessel size requirements for motor and oar operated vessel designs. It is so because a pivot cannot physically sustain higher pressure and will break.

A second disadvantage is that boats operated with devices designed according to the above mentioned patents can move only forward, and do not have modes of moving backwards or braking. It must be stressed that having all three modes of forward, backward and braking is a vital feature for all vessels.

Therefore above mentioned patents can not be used at all for any motor-operated and large size vessels.

SUMMARY OF THE INVENTION

It is an object of the present invention to provide an improved construction of an oar or paddle to eliminate disadvantages of the prior art, and to allow operating a vessel of any size having a motor with all three modes of movement of forward, backward and braking. A distinct feature of the device of this invention is its ability to operate under high pressure on an oar or paddle associated with moving large engine-driven vessels.

BRIEF DESCRIPTION OF THE DRAWINGS

In order that the invention can be understood and readily carried into effect and so that the above object will become apparent, a paddle in accordance with the invention will now be described, by way of example only, with reference to the accompanying drawings, in which, FIG. 3 is a front and side views of a moving plate, FIG. 4 is a front view of the frame and movable plates, FIG. 4A is a cross sectional view through line I-I of FIG. 4 of the frame and moving plates assembled together.

DETAILED DESCRIPTION OF THE INVENTION

Detailed description of the preferred embodiment is provided herein. It is to be understood, however, that the present invention may be embodied in various forms. Various aspects of the invention may be inverted or changed in reference to specific part, shape and detail, part's location, or part's composition.

Therefore, specific details disclosed herein are not to be interpreted as limiting, but rather as basis for the claims and as a representative basis for teaching one skills in the art to employ the present invention in virtually any appropriately detailed system, structure or manner.

Figure 1A:
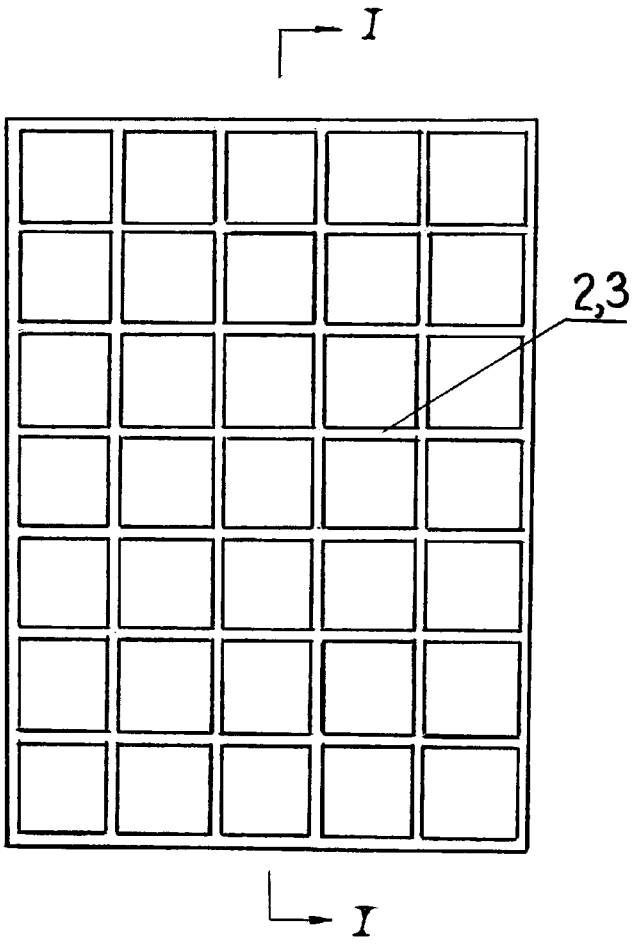
FIGS. 1A and 1B are a front view and a sectional view on line I-I of a lattice in accordance with invention.
Figure 1B:
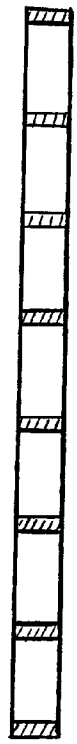
Figure 2A:
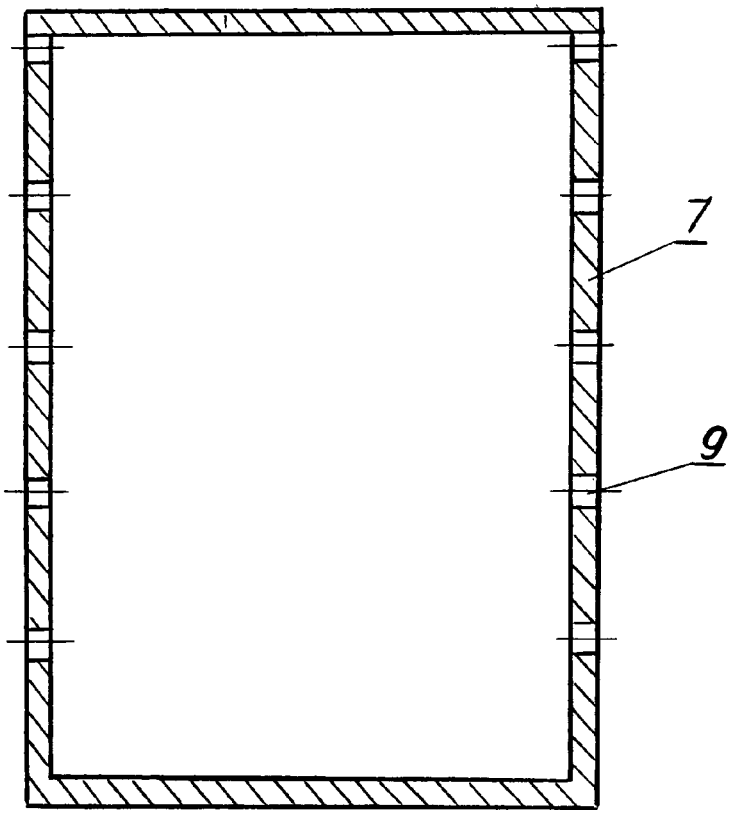
FIGS. 2A and 2B are a front view on line I-I of a frame in accordance with the invention.
Figure 2B:
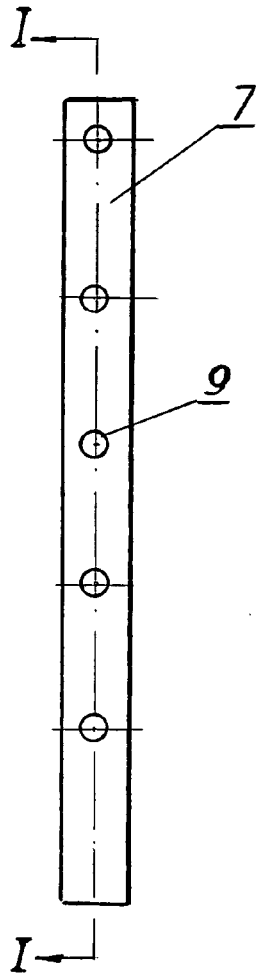
Figure 4B:
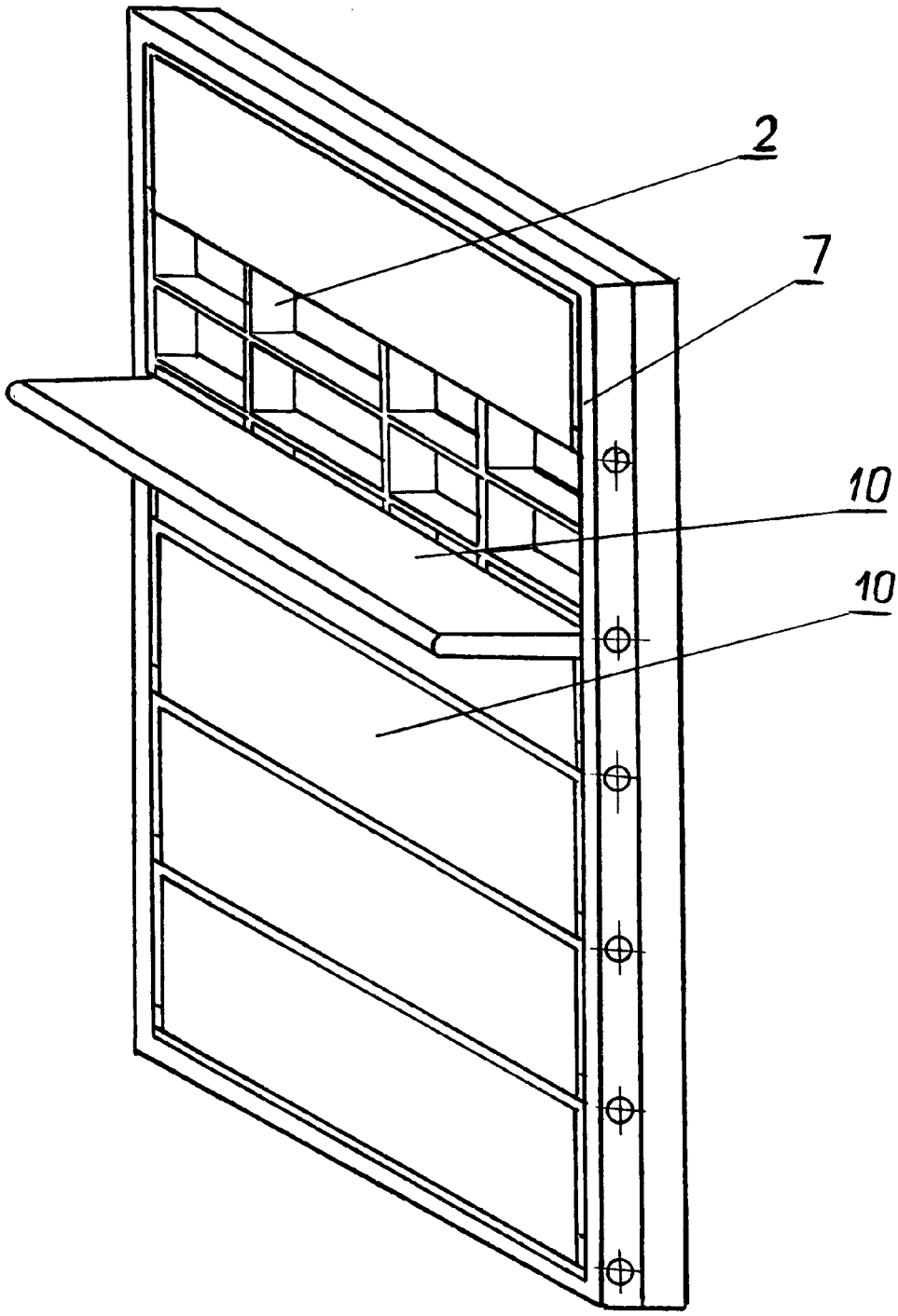
FIG. 4B is a view of one of the lattice lattices assembled with the frame and moving plates.
Figure 6:
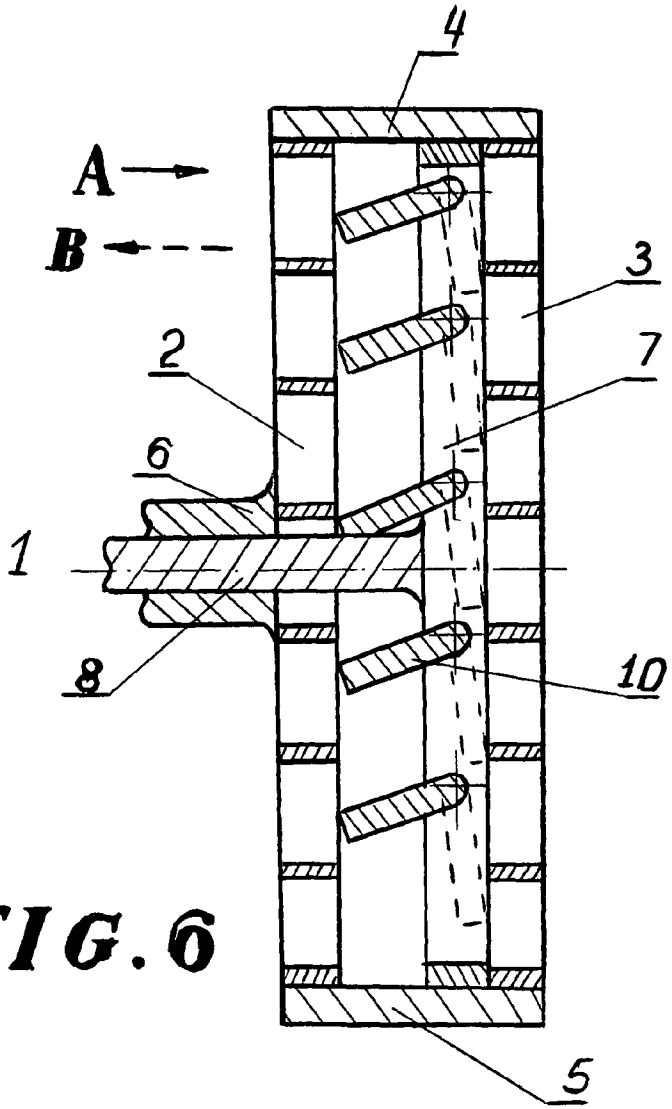
FIG. 6 is a cross sectional exploded view of the parts of the paddle assembled together in at a backward movement of the vessel.
Figure 5:
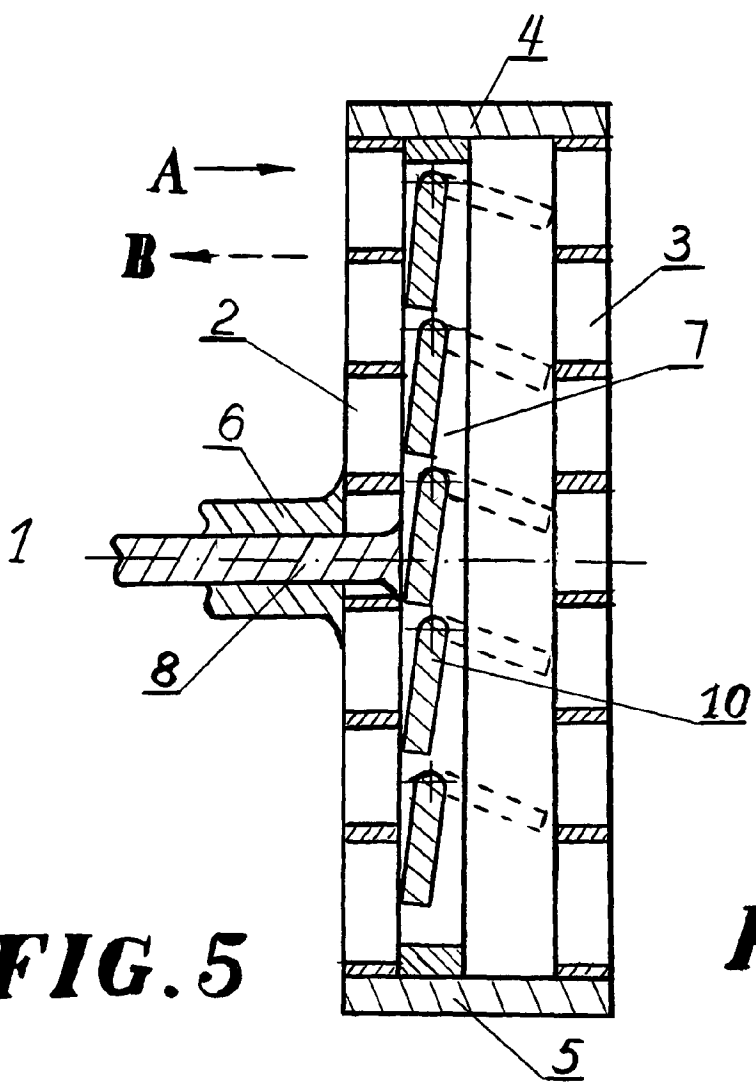
FIG. 5 is a cross sectional view of the parts of the paddle assembled together at a forward movement of the vessel.

Referring to FIGS. 1 to 6 of the drawings, number 1 indicates a paddle (FIGS. 5 and 6) comprising of two parallel lattices 2 and 3 (FIGS. 1A and 1B) hard connected with each other at a distance by beams 4 and 5 where lattice 2 is hard connected with first shaft 6, and frame 7 (FIGS. 2A and 2B) is hard connected with second shaft 8 where frame 7 moves between lattices 2 and 3. Second shaft 8 moves forward or backward inside first shaft 6. Shaft 6 is connected to the engine to move the paddle backward and forward. Second shaft 8 is connected to the vessel's mode of movement of backward and forward controller that moves frame 7 to lattice 2 for a forward movement of the vessel or to lattice 3 for a backward movement of the vessel. Frame 7 (FIGS. 2A and 2B) has a multitude of pairs of parallel openings 9 of circular cross section extending throughout its length where each pair of openings 9 supports individual plates 10 as shown in FIGS. 3-6. Individual plate 10 can rotate in any direction as drawn by broken lines as seen in FIG. 4A. A front view of lattice 3 assembled with frame 7 and moving plates 10 is shown in FIG. 4B. The way two parallel lattices 2 and 3 are hard connected, as shown in FIGS. 5 and 6, and protect plates 10 from being broken while taking water pressure in full.

When the above described paddle 1 is in use and the frame 7 is connected with the lattice 2 (FIG. 5), and the paddle 1 starts to move in the direction indicated by arrow A, which is an opposite to the direction in which vessel is to travel, as indicated by arrow B, paddle 1 is then pulled to perform a power stroke whereby plates 10 move in the direction indicated by arrow B, during which movement the reaction of the water on plates 10 forces them to align to a straight line position shown in FIG. 5 of the drawing in a full line thus being firmly pressed to the surface of lattice 2, and the vessel is propelled through the water. While in this position, plates 10 transfer pressure of the water on lattice 2 that can be designed to sustain any pressure within parameters given by vessels engine characteristics, or desirable ones. It is so because lattices can be constructed from beams of different sizes and variety of durable materials.

When paddle 1 is pushed in an opposite direction indicated by arrow B (FIG. 5), plates 10 being immersed in water are moved by the force of the resistance of the water to the broken line position shown in FIG. 5 of the drawing in which they are aligned parallel to each other while touching lattice 3. It must be stressed that this movement doesn't slow down the vessel.

It will be seen therefore that because the paddle 1 can be returned to the starting position for a subsequent power stroke without being removed from the water, these movements are used to move a motor-operated vessel forward (forward mode).

When the above described paddle 1 is in use and frame 7 is connected with lattice 3 (FIG. 6), and paddle 1 starts to move in the direction indicated by arrow A, which is opposite to the direction in which the vessel is traveling, as indicated by arrow B, paddle 1 is then pulled to perform a reverse stroke whereby plates 10 shown in full line move in the direction indicated by arrow B, during which movement the reaction of the water on plates 10 forces them to align parallel to each other while touching lattice 2, and the vessel keeps on moving forward in a direction indicated by arrow B without slowing down.

When paddle 1 is pushed in an opposite direction indicated by arrow B (FIG. 6), plates 10 being immersed in water are moved by the force of the resistance of the water to the broken line position shown in FIG. 6 where they are aligned to a straight line position shown in FIG. 6 of the drawing thus being firmly pressed to the surface of lattice 3. Paddle 1 performs power stroke being immersed in water. Thus moving paddle 1 in the direction shown by arrow A in FIG. 6 will slow a vessel, and then stop it, and then start moving in the direction of arrow A, if needed (backward mode).

It will be seen therefore that because paddle 1 can be returned to the starting position for a subsequent power stroke without being removed from the water, these movements are used to move a motor-operated vessel backward, slowing down, and bringing to a stop. Shaft 8 is connected with a vessel's mode control mechanism. Shaft 8 is moving forward or backward inside of a shaft 6. Shaft 6 is connected to the engine to move paddle backward and forward. Shaft 8 is connected to mechanism that moves a frame to lattice 2 for a forward movement of the vessel or lattice 3 for a backward movement of the vessel.

Figure 8:
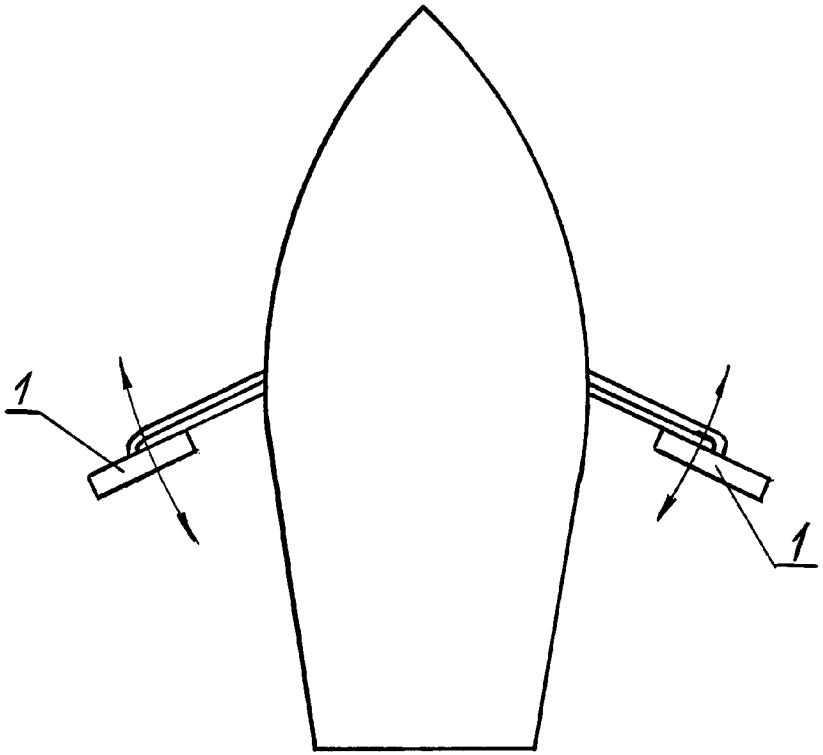
FIG. 8 is a top view of a vessel with paddle mounted on the sides.
Figure 7:
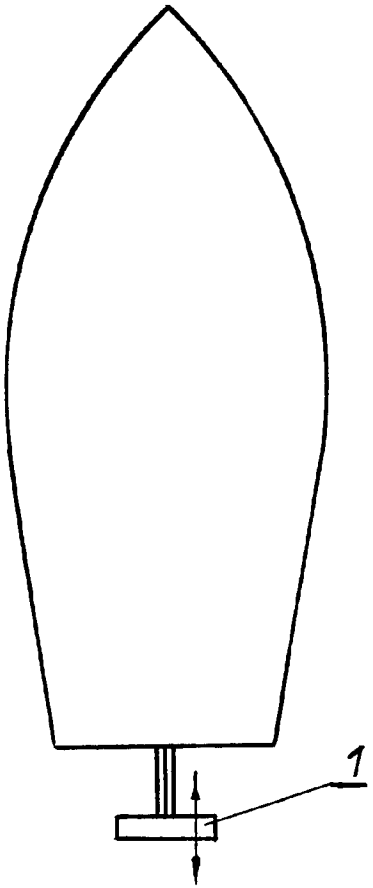
FIG. 7 is a top view of a vessel with paddle mounted at the back.

FIGS. 7 and 8 show a top view of the positioning of paddle 1 at the vessel's stern (FIG. 7) or as a pair or multitude of pairs at the vessel's left and right sides (FIG. 8) as examples of positioning options. It is also possible to make a vessel start and keep on moving in partial or full circle, if as positioned in (FIG. 8), paddle 1 on one side is working in forward mode and paddle 1 on the other side is working in backward mode simultaneously.

Whilst in the above examples the invention has been described in relation to an oar or paddle, it is also applicable to a motor operated vessel of any size, and provides modes of moving forward, backward, slowing down, and stopping, and rotating as needed.

We claim:

1. A device for moving a vessel having an engine forward and backward through water, comprising:

a first shaft having a first end and a second end, said first shaft having an opening defined therein of circular cross-section;

a second shaft having a first end and a second end, said second shaft movably disposed within said opening defined in said first shaft;

said vessel having a backward and forward movement controller;

first and second lattices disposed parallel to one another at a distance, said first lattice connected to said first end of said first shaft;

a frame disposed between said first and second lattices, said frame being connected to said first end of said second shaft, said frame movable between said first and second lattices, said frame having a plurality of parallel grooves defined therein, said grooves being of substantially circular cross-section; and a plurality of plate members, each having support portions, each plate member pivotally supported in said parallel grooves, said plate members being positioned axially of said grooves and supported by said support portions of said plate members disposed within said grooves, said grooves having a peripheral extent sufficient to permit said plate members to rotate.

2. The device of claim 1 wherein said second end of said first shaft is connected to said engine of said vessel and said first shaft is moved back and forth by said engine of said vessel.

3. The device of claim 1 wherein said second end of said second shaft is connected to said vessel's backward and forward movement controller.

4. The device of claim 2 wherein said second end of said second shaft is connected to said vessel's backward and forward movement controller.

5. A device for propelling a vessel in water, comprising:

a paddle including:

an engine having motive means for moving said vessel in water;

a mode control mechanism that selectively moves forward and backward;

a first shaft having first and second ends, said first shaft having an aperture defined therein, said second end of said first shaft attached to said engine;

a second shaft having first and second ends, said second shaft positioned within said aperture defined in said first shaft, said second end of said second shaft being attached to said mode control mechanism;

a first lattice having a plurality of openings defined therein, said first lattice having a top and a bottom;

a second lattice having a plurality of openings defined therein, said second lattice having a top and a bottom;

a first beam connecting said tops of said first and second lattices;

a second beam connecting said bottoms of said first and second lattices, such that said first and second lattices are disposed parallel to one another and have a space defined therebetween;

a frame member having a length movably disposed between said first and second lattices, said frame member having a plurality of pairs of parallel openings defined along said length of said frame member, said frame member being attached to said first end of said second shaft;

a plurality of plate members, each including means of support engaged into a parallel pair of said openings defined in said frame, said plate members being rotatable within said frame from a first position to a second position, and vice versa;

said engine being able to move said first shaft forward or backward for propelling said vessel while said second shaft is moved backward or forward by said mode controller to move said frame from said first lattice to said second lattice to change a directional force of said paddle; and said plate members, when moved by pressure of the water, being aligned parallel to each other when said frame is contacting said first lattice such that when said paddle is pushed rearward away from said vessel, said aligned plates force water rearwardly, moving said vessel forward; and when said paddle is pulled forward toward said vessel, said plate members rotate in said openings in said frame allowing water to pass freely through said paddle which forward propelling action is repeated by the engine moving said first shaft and attached paddle backward and forward in the water.

6. The device of claim 5 further being disposed in a mode to move said vessel rearward by having said mode controller move said second shaft and said frame to be adjacent to said second lattice wherein upon a forward pull of said engine on said first shaft pulling said paddle forward, said plates align parallel to one another against said second lattice blocking said water flow through said paddle, thereby pulling said vessel rearward and which upon said movement of said paddle rearward away from said vessel by said engine causing said plates to rotate toward said first lattice opening, allowing the flow of water freely therethrough, and allowing said paddle to move freely through said water to get ready for the next rearward-pulling stroke.

* * * * *